US010934898B1

(12) United States Patent
Parker et al.

(10) Patent No.: US 10,934,898 B1
(45) Date of Patent: Mar. 2, 2021

(54) CAM PHASER AND OPERATING METHOD

(71) Applicant: ECO Holding 1 GmbH, Marktheidenfeld (DE)

(72) Inventors: Kenneth Parker, Clarkston, MI (US); Mustafa Mohammed, Rochester Hills, MI (US); Tim Wells, Sterling Heights, MI (US); John Snyder, Irving, TX (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/858,642

(22) Filed: Apr. 26, 2020

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01)

(58) Field of Classification Search
CPC ..... F01L 1/3442; F01L 2001/34433
See application file for complete search history.

(56) References Cited

U.S. PATENT DOCUMENTS

2017/0058727 A1* 3/2017 Smith ..... F01L 1/047

FOREIGN PATENT DOCUMENTS

EP 1447528 A2 8/2004

* cited by examiner

*Primary Examiner* — Zelalem Eshete
(74) *Attorney, Agent, or Firm* — Von Rohrscheidt Patents

(57) ABSTRACT

A cam phaser for an internal combustion engine, the cam phaser including a stator including vane cells; a rotor configured rotatable relative to the stator and including vanes arranged in the vane cells of the stator, wherein the vanes respectively divide the vane cells into advance chambers and retard chambers; a control valve configured to move the rotor at least between an advance position and a retard position, wherein the control valve includes a hollow piston that is axially movable within a piston channel, a pressure medium connection, a tank connection and at least four operating connections including at least one advance connection and at least one retard connection, wherein each of the vane cells includes an advance chamber that is connected to the control valve through the at least one advance connection and a retard chamber connected to the control valve through the at least one retard connection.

15 Claims, 2 Drawing Sheets

CAM PHASER AND OPERATING METHOD

FIELD OF THE INVENTION

The invention relates to a vane type cam phaser for an internal combustion engine with a stator including vane cells, a rotor that is rotatable relative to the stator and includes vanes that are arranged in the vane cells of the stator and a control valve for moving the rotor. The invention furthermore relates to a method for operating the cam phaser.

BACKGROUND OF THE INVENTION

Cam phasers are used in valve trains of internal combustion engines in order to adjust a phase relationship between crank shaft and cam shaft in an optimum variable manner. The adjustment is performed by a fluid flow through control valves that control the fluid flow within the cam phaser and towards a tank. In particular the control valves include plural switching positions configured to adjust a path of the fluid flow. Thus, the cam phaser and the cam shaft are adjusted into a predetermined phase as a function of the switching position of the control valve.

Cam phasers are well known in the art. EP 1 447 528 A2 discloses a vane type cam phaser. This cam phaser includes a stator and a rotor that are arranged in a housing, wherein the stator and the rotor define at least one advance chamber and at least one retard chamber, wherein at least one controllable fluid leak device is provided between the at least one advance chamber and the at least one retard chamber.

BRIEF SUMMARY OF THE INVENTION

Thus, it is an object of the invention to improve the configuration and function of a cam phaser and make its operations more efficient.

According to an advantageous embodiment the object is achieved by a vane type cam phaser for an internal combustion engine, the cam phaser including a stator, a rotor and a control valve configured to move the rotor at least between an advance position and a retard position. The stator includes vane cells. The rotor is rotatable relative to the stator and includes vanes that are arranged in the vane cells of the stator. Thus, the vanes divide the vane cells respectively into an advance chamber and a retard chamber.

The control valve includes a hollow piston that is axially movable within a piston channel and control valve connections including: a pressure medium connection, a tank connection and at least four operating connections. In each vane cell one of the operating connections is configured as an advance connection to the advance chamber and one of the operating connections is configured as a retard connection to the retard chamber. Thus, the control valve is configured so that at least one of the advance connections is connected with the pressure medium connection in order to move the rotor into the advance position and at least another of the advance connections and all of retard connections are connected with the tank connection.

Advantageous embodiments are defined in the dependent claims and in additional independent claims.

The improved cam phaser has the advantage that a significantly smaller amount of pressure medium subsequently designated as fluid has to be introduced from the pressure medium connection into the advance chambers in order to move the rotor into the advance position. This is primarily achieved in that only one or a small number in any case not all of the advance chambers of the cam phaser are filled with the fluid from the pressure medium connection. Thus, there is at least one vane cell in which neither the advance chamber nor the retard chamber is filled with the fluid from the pressure medium connection. A smaller fluid volume can be moved more quickly so that an adjustment speed of the cam phaser can be increased.

Subsequently the advance chambers and the retard chambers are jointly referred to as operating chambers and the advance connections and the retard connections are jointly referred to as operating connections. As a matter of principle the number of operating chambers always corresponds to the number of operating connections. Thus there is a total of four variants of operating connections, subsequently designated as A1, A2, B1 and B2, wherein there are two advance connections variants A1 and A2 and two retard connection variants B1 and B2. Each of the advance connection variants A1, A2, B1, B2 has to be used in the cam phaser at least once, however, it can also be used several times.

Similar to the movement of the rotor into the advance position described supra the rotor is also movable into the retard position. According to another embodiment at least one of the retard connections is connected e.g. through the operating connection variant B1 with the pressure medium connection for moving the rotor into the retard position and at least one additional retard connection is connected e.g. through the operating connection variant B2 with the pressure medium connection and all advance connections are connected with the tank connection e.g. through the operating connection variants A1 and A2.

Also in this embodiment there is at least one vane cell where neither the advance chamber nor the retard chamber is filled with the fluid from the pressure medium connection when the rotor is moved. The advantages like increased adjustment speed of the cam phaser that were recited in combination with moving the rotor into the advance position also apply here.

In an advantageous embodiment the hollow piston is movable into at least a first switching position and a second switching position. Thus, the following applies: when the hollow position is in the first switching position, the at least one retard connection is connected with the pressure medium connection, e.g. by the operating connection variant B1 and the at least one additional retard connection is connected with the tank connection e.g. through the operating connection variant B2 and all advance connections, thus all operating connections of the operating connection variants A1 and A2 are connected with the tank connection.

However, when the hollow piston is in the second switching position the at least one advance connection is connected with the pressure medium connection e.g. through the operating connection variant A2 and the at least one additional advance connection is connected with the tank connection, e.g. through the operating connection variant A1 and all retard connections plus all operating connection of the operating connection variants B1 and B2 are connected with the tank connection.

Thus, the rotor is moved into the retard position in the first switching position of the hollow piston and moved into the advance position in the second switching position of the hollow piston. In each switching position of the hollow piston only one variant of the operating connections is pressurized or connected with the pressure medium connection, thus only the operating connections are connected through one of the operating connection variants A1, A2, B1 or B2. The illustrated embodiment of the hollow piston causes the cam phaser in a simple manner to move the rotor into an advance position or a retard position.

According to the invention the control valve includes a housing wall with at least one tank drain channel that extends parallel to the piston channel and that is connected at least with the tank connection.

The tank drain channel provides an additional connection between the piston channel and the tank connection which can be required depending on a switching position and a configuration of the hollow piston. When an operating connection or an operating chamber connected with the operating connection shall be made free from pressure the operating connection has to be connected with the tank connection. Only then a fluid arranged in the operating connection can drain.

Typically the fluid drains from the operating chamber through the piston channel directly towards the tank connection. Depending on the switching position and the configuration of the hollow piston access or inflow into the tank connection can be blocked by the hollow piston. In this case the tank drain channel is helpful. In particular the fluid is then conducted from the operating connection out of the piston channel initially in an opposite direction to the tank connection and then conducted further or returned through the tank drain channel in a direction towards the tank connection. Thus, the tank drain connection facilitates rendering a plurality of operating chambers without pressure in a simple manner.

According to an advantageous embodiment one of the advance chambers is connected with one of the retard chambers through at least one first check valve that is conductive in a direction towards the retard chamber.

The first check valve supports moving the rotor into the retard position in that an additional fluid flow runs from the advance chamber into the retard chamber. Thus, a smaller amount of fresh fluid has to be feed through the pressure medium connection into the retard chamber and less fluid has to be displaced from the advance chamber or drained into the tank connection. This increases an adjustment speed of the cam phaser in a direction towards the retard position.

However, when the rotor is not moved into the retard position but into the advance position the first check valve shall remain without function, thus closed. Thus, it is advantageous that the two operating chambers that are connected by the first check valve are rendered without pressure or connected with the tank connection when the rotor is moved into the advance position. This prevents an uncontrolled opening and closing of the first check valve.

Inverting the preceding embodiment another advantageous embodiment connects one of the advance chambers with one of the retard chambers through at least one second check valve that is conductive in a direction towards the advance chamber.

The second check valve supports moving the rotor into the advance position in that an additional fluid flow is provided from the retard chamber into the advance chamber, thus a smaller amount of fresh fluid has to be fed through the pressure medium connection into the advance chamber and a smaller amount of fluid has to be displaced from the retard chamber or drained into the tank connection. This increases the adjustment speed of the cam phaser in a direction towards the advance position.

This second check valve shall remain without function, thus closed which is different from the first check valve, when the rotor is moved into the retard position. Thus, it is advantageous that the two operating chambers that are connected by the second check valve are rendered without pressure or connected with the tank connection when the rotor is moved into the retard position. In this case uncontrolled opening and closing of the second check valve is prevented.

Advantageously at least one of the first check valve and the second check valve is arranged in at least one of the vanes of the rotor.

Thus, a vane advantageously includes one check valve at the most. When a check valve is arranged in a vane the two operating chambers of the respective vane cell are flow connected with each other in one direction. In particular the first check valve flow connects the operating chambers in a direction towards the retard chamber and the second check valve flow connects the operating chamber in a direction towards the advance chamber. Thus, the first check valve supports a rotor movement into the retard position and the second check valve supports a rotor movement into the advance position. Arranging a check valve in a vane is particularly space saving and facilitates more flexibility when designing the stator and the control valve e.g. with respect to arranging the operating connections. By the same token efficiency of fluid conduction can be improved when arranging the check valve in the vane due to the short path between the operating chambers.

In another advantageous embodiment at least one of the first check valve and the second check valve is arranged in the stator.

Advantageously at the most one check valve is arranged in a portion between two vane cells of the stator. When a check valve is arranged in a portion between two vane cells an advance chamber of the first vane cell is flow connected with a retard chamber of the second vane cell. Accordingly the first check valve that is fluid conductive or permeable in a direction towards the retard chamber supports the rotor movement into the retard position. The second check valve, however, that is permeable in the direction towards the advance chamber supports the rotor movement into the advance position. Arranging the check valves in the stator facilitates more flexibility for positioning the check valves and more flexibility in designing the vanes of the rotor. The check valve is producible in a cost effective manner.

According to the invention the check valves are advantageously also arranged in combination, thus in the stator as well as in at least one vane of the rotor. Thus, it is possible e.g. that a retard chamber is connected with the two adjacent advance chambers through two first check valves. Since the first check valves are permeable in the direction towards the retard chamber the first check valves support the rotor movement into the retard position in two ways. By the same token it is possible to connect an advance chamber accordingly through two second check valves in a flow conducting manner with the two adjacent retard chambers in order to provide double support for the rotor movement into the advance position. In other embodiments a first check valve is arranged in a vane and a second check valve is arranged in the stator or vice versa a first check valve is arranged in the stator and a second check valve is arranged in a vane. The plurality of combination options provides a high level of flexibility in the design of the cam phaser.

In an advantageous embodiment the hollow piston includes an inflow portion that is connected with the pressure medium connection and a back flow portion that is connected with the tank drain. Thus, the inflow portion and the back flow portion are separated from each other by a third check valve that is permeable towards the inflow portion.

The third check valve facilitates using fluid over again which has already run through an operating chamber. In particular a portion of the fluid which is conducted from one or plural operating chambers to the tank connection is fed to the backflow portion of the hollow piston. The fluid can run through the third check valve into the inflow portion of the hollow piston and can be conducted into one or plural operating chambers together with the fresh fluid that is fed through the pressure medium connection. Thus, recirculation occurs, thus a smaller amount of fresh fluid has to be supplied through the pressure medium connection to move the rotor. Thus, the third check valve like the first and the second check valve increase an adjustment speed of the cam phaser.

Another advantage of the three described arrangement variants of the check valves designated as first, second, third check valves results from the increased volume of recirculated fluid. Thus, a risk of sucking air into the cam phaser is substantially reduced which significantly improves controllability and stability of the cam phaser.

According to another advantageous embodiment of the cam phaser at least one of the vanes and its associated vane cell has a reduced diameter compared to at least one other vane and its associated vane cell.

Through the different diameters the operating chambers are configured with different sizes and thus adapted to their functional requirements with respect to fluid pressure. When reducing the diameter also the operating chambers of the respective vane cell become smaller. The smaller operating chamber help to establish pressure more quickly since less fluid has to be fed to fill the operating chamber. On the other hand side the operating chamber can only generate a small pressure force for moving the rotor due to the small volume. Vice versa the larger operating chamber builds up pressure more slowly but generates a higher pressure force.

In an advantageous embodiment a first vane cell moves the rotor into the retard position and a second vane cell moves the rotor into the advance position. Friction forces and inertia forces that occur at and in the cam shaft and the cam phaser have different effects on the two opposite rotor movements. Thus, the rotor movement into the retard position requires another pressure force than the rotor movement into the advance position. The respectively required pressure force is adjustable by accordingly selecting a diameter of the respective vane cell and of the vane arranged therein. Thus, the difference in required pressure force for moving the rotor into the retard position and into the advance position is balanced or compensated.

This compensation is possible in addition to a described adaptation of the diameter of one or plural vanes by choosing a number of arranged first and second check valves accordingly. Thus, e.g. a larger number of first check valves than second check valves can be arranged in the cam phaser in order to support the rotor movement towards the retard position more strongly than the rotor movement into the advance position. Vice versa the rotor movement into the advance position can be supported more strongly when more second check valves than first check valves are arranged in the cam phaser. By the same token also plural vanes are conceivable.

In an advantageous embodiment at least one vane includes a recess and is arrestable at the stator by a safety pin that engages the recess.

Thus, freedom of movement between the rotor and the stator can be restricted or prevented. Thus, the vane is advantageously arrestable in a position between the retard position and advance position, thus in a position where the vane does not contact a wall of the vane cell. This arresting renders the cam phaser inoperative and/or prevents unintentional movement of the rotor, e.g. after switching the internal combustion engine off and/or when transporting the cam phaser.

According to another advantageous embodiment the object is achieved by a method for operating a cam phaser. Thus, the cam phaser includes a stator and a rotor that forms plural advance chambers and retard chambers and a control valve with a hollow piston that is axially moveable in a piston channel between at least two switching positions. The method has similar advantages as the cam phaser according to the invention and includes the steps: displacing the hollow piston within the piston channel into a first switching position or a second switching position and flowing a fluid from a pressure medium connection into the hollow piston. Furthermore the method either includes the steps introducing the fluid into at least one of the advance chambers and draining the fluid at least from one other advance chamber and from all retard chambers or the steps: introducing the fluid into at least one of the retard chambers and draining the fluid from at least one additional retard chamber and from all advance chambers.

Advantageously at least a portion of the fluid is drained through at least one first check valve arranged in the rotor and/or in the stator from at least one of the advance chambers into at least one of the retard chambers when the fluid flowing in directly from the pressure medium connection is conducted into the at least one retard chamber.

As recited supra movement of the rotor into the retard position is accelerated.

Furthermore draining advantageously includes conducting at least a portion of the fluid through at least one second check valve that is arranged in the rotor and/or in the stator from at least one of the retard chambers into at least one of the advance chambers when the fluid that flows in directly from the pressure medium connection is introduced into the at least one advance chamber. Thus, the movement of the rotor into the advance position is accelerated as recited supra.

Furthermore a portion of the fluid is returned into the hollow piston when the fluid is drained and added into the fluid that flows in directly from the pressure medium connection through a third check valve that is arranged in the hollow piston. The added fluid is thus flowed into the at least one operating chamber again. Thus, recirculation occurs which leads to an increased adjustment speed of the cam phaser.

BRIEF DESCRIPTION OF THE DRAWINGS

Additional advantages of the invention can be derived from the detailed description and from advantageous embodiments illustrated in the drawing figure, wherein.

DETAILED DESCRIPTION OF THE INVENTION

A cam phaser illustrated in FIGS. 1-3B facilitates variably adjusting a phase relationship between crankshaft and camshaft in a valve train of an internal combustion engine.

Figure 1:
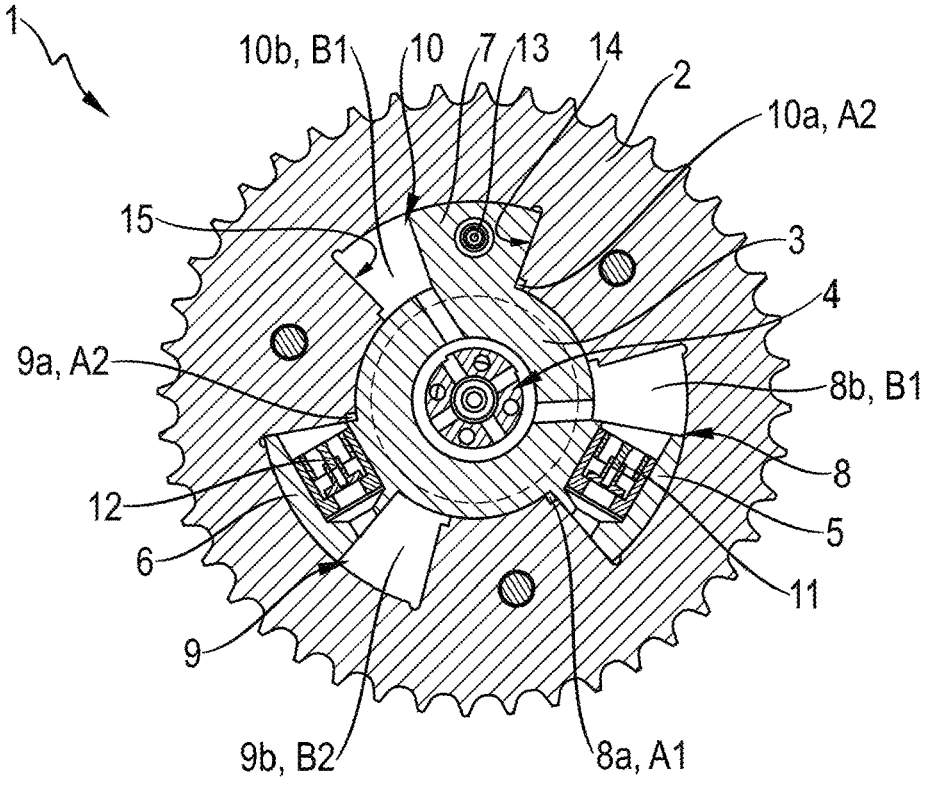
FIG. 1 illustrates a cross section of a cam phaser according to the invention in a first embodiment.

FIG. 1 illustrates a cam phaser 1 in a cross sectional view and in a first embodiment wherein the cam phaser includes a stator 2 and a rotor 3 which are arranged about a central control valve 4. The rotor 3 directly adjoins the central control valve 4 in cross sectional view wherein the rotor includes three vanes 5, 6, 7 and is arranged within the stator 2. The stator 2 includes three vane cells 8, 9, 10 wherein a respective vane 5, 6, 7 of the rotor 3 is arranged in each vane cell.

In particular a first vane 5 is arranged in the first vane cell 8, a second vane 6 is arranged in the second vane cell 9, and the third vane 7 is arranged in the third vane cell 10. Thus, the vane cells 8, 9, 10 together with the vanes 5, 6, 7 form a total of six operating chambers 8*a*, 8*b*, 9*a*, 9*b*, 10*a*, 10*b*, wherein each vane cell 8, 9, 10 forms an advance chamber 8*a*, 9*a*, 10*a* and a retard chamber 8*b*, 9*b*, 10*b*.

The first vane 5 includes a first check valve 11 that is permeable in a direction towards the first retard chamber 8*b* and that flow connects the operating chambers 8*a*, 8*b* with each other. Additionally the second vane 6 includes a second check valve 12 that is permeable in a direction towards the second advance chamber 9*a* and that flow connects the operating chambers 9*a, b* with each other.

Subsequently a check valve that is permeable in a direction towards a retard chamber 8*b*, 9*b*, 10*b* is designated as a first check valve 11 and a check valve that is permeable in a direction towards an advance chamber 8*a*, 9*a*, 10*a* is designated as a second check valve 12.

A recess 13 is formed in the third vane 7 wherein a safety pin engages the recess to arrest the rotor 3 at the stator 2.

The control valve 4 is configured to move the rotor 3 at least between a retard position 14 and an advance position 15. The retard position 14 and the advance position 15 are designated in FIG. 1 only with respect to the vane cell 10. In the retard position 14 each of the vanes 5, 6, 7 is applied to an inner wall of the respective vane cell 8, 9, 10 so that a size of the respective retard chamber 8*b*, 9*b*, 10*b* is maximized. Accordingly the size of the respective advance chamber 8*a*, 9*a*, 10*a* is minimized in the retard position 14 of the rotor 3. FIG. 1 illustrates the rotor 3 in the retard position 14. Vice versa all advance chambers 8*a*, 9*a*, 10*a* are size maximized in the advance position 15 and all retard chambers 8*b*, 9*b*, 10*b* are size minimized.

The rotor 3 is moved by flowing or pressing a pressure medium or fluid through the control valve 4 into at least one of the operating chambers 8*a*, 8*b*, 9*a*, 9*b*, 10*a*, 10*b*. Simultaneously the control valve 4 facilitates draining the fluid from the other operating chambers 8*a*, 8*b*, 9*a*, 9*b*, 10*a*, 10*b*. Thus, the operating chambers 8*a*, 8*b*, 9*a*, 9*b*, 10*a*, 10*b* are respectively connected with one of six operating connections of the control valve 4 that will be described infra. The operating connections are thus overall grouped in four operating connection variants A1, A2, B1, B2 wherein each operating connection variant is implemented at least once at the control valve 4 and is connected with at least one of the operating chambers 8*a*, 8*b*, 9*a*, 9*b*, 10*a*, 10*b*. In particular the operating connection variants A1, A2, B1, B2 are two advance connection variants A1, A2 to be connected to the advance chambers 8*a*, 9*a*, 10*a* and two retard connection variants B1, B2 to be connected to the retard chambers 8*b*, 9*b*, 10*b*.

The operating connection variants A1, A2, B1, B2 are characterized in that operating connections that are associated with a respective operating connection variant A1, A2, B1, B2 are always loaded in the same manner. Put differently all operating connections that are associated with a respective operating connection variant A1, A2, B1, or B2 are jointly connected with an inflow (pressure medium connection P) or drain (tank connection). Thus, a fluid is either pressed through all or through none of the operating connections of a particular operating variant A1, A2, B1, or B2.

In FIG. 1 the individual operating chambers 8*a*, 8*b*, 9*a*, 9*b*, 10*a*, 10*b* are associated with the respective operating connection variants A1, A2, B1, B2 with a corresponding supplementation of the reference numerals. Thus "8*b*, B1" designates the first retard chamber 8*b* that is connected with an operating connection of the retard connection variant B1.

According to the invention, the control valve 4 is configured to move the rotor 3 into the retard position 14 so that fluid is pressed into at least one of the retard chambers 8*b*, 9*b*, 10*b* and so that fluid can drain from at least one additional retard chamber 8*b*, 9*b*, 10*b* and all advance chambers 8*a*, 9*a*, 10*a*. Thus, in particular fluid is pressed into the retard chambers 8*b*, 10*b* that are connected with an operating connection of the operating connection variant B1. Furthermore fluid can drain from the retard chamber 9*b* that is connected with the operating connection of the operating connection variant B2.

Figure 3A:
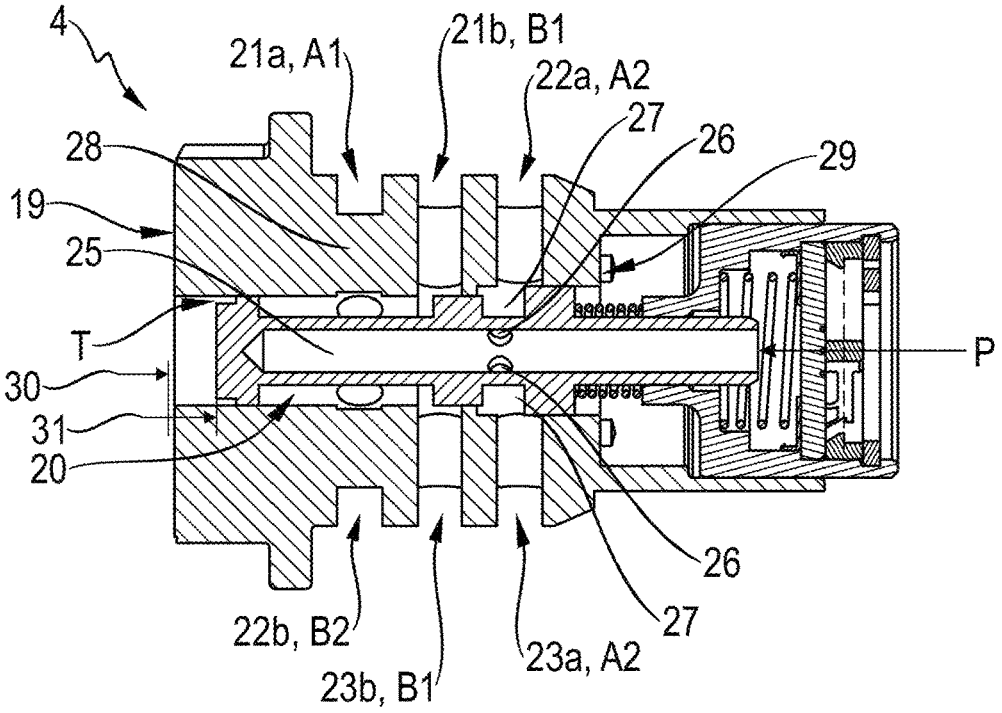
FIG. 3A illustrates a first longitudinal cross section of the control valve of FIG. 1 with a hollow piston in a first embodiment.
Figure 3B:
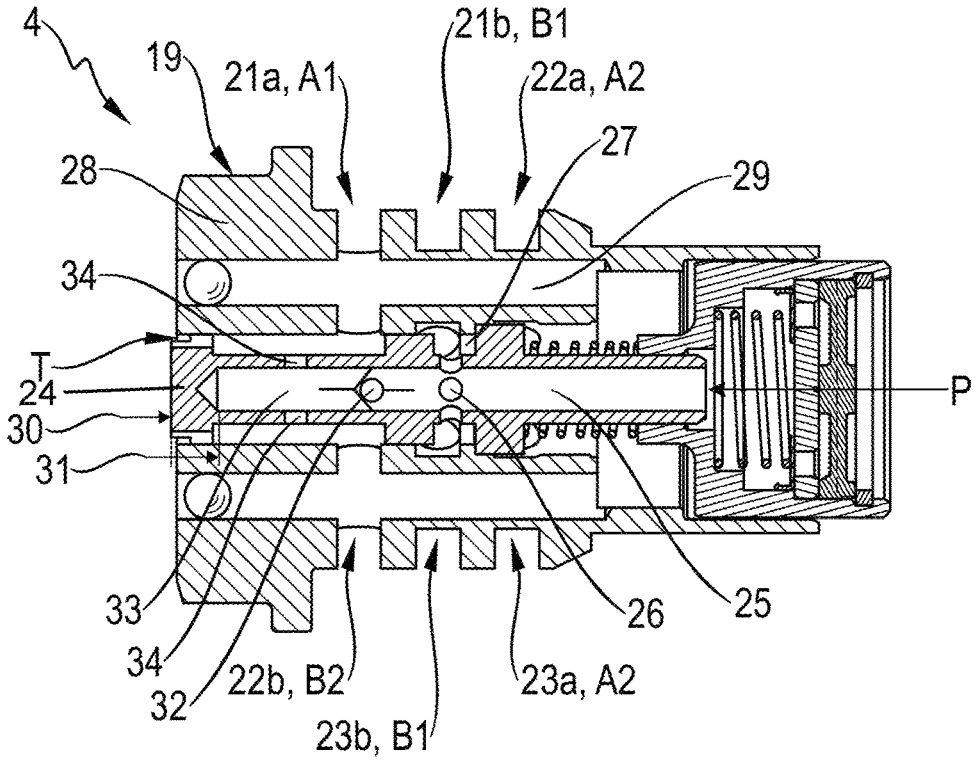
FIG. 3B illustrates a second longitudinal cross section of the control valve according to the invention of FIG. 1 with a hollow piston in a second embodiment.

Accordingly the control valve 4 is configured to move the rotor 3 into the advance position 15 so that fluid is pressed into at least one of the advance chambers 8*a*, 9*a*, 10*a* and so that fluid can drain from at least one additional advance chamber 9*a*, 10*a* and all retard chambers 8*b*, 9*b*, 10*b*. Thus, fluid is pressed into the advance chambers 9*a*, 10*a* that are connected with an operating connection of the operating connection variant A2. Furthermore fluid can drain from the advance chamber 8*a* that is connected with the operating connection of the operating connection variant A1. FIGS. 3*a* and 3*b* describe the required structure of the control valve 4 in more detail.

The check valves 11, 12 in the vanes 5, 6 are configured to support the movement of the rotor 3 in that an additional fluid flow is run from an operating chamber 8*a*, 8*b*, 9*a*, 9*b*, 10*a*, 10*b* to be emptied into an operating chamber 8*a*, 8*b*, 9*a*, 9*b*, 10*a*, 10*b* to be filled. Thus, a recirculation of the fluid is provided between the operating chambers 8*a*, 8*b*, 9*a*, 9*b*, 10*a*, 10*b* so that a smaller amount of fluid has to be pressed into the cam phaser 1 and a lesser amount of fluid has to drain from the cam phaser 1. Put in short less fluid has to be moved. This accelerates the movement of the rotor 3 and thus increases an adjustment speed of the cam phaser 1.

In this first embodiment the first check valve 11 supports moving the rotor 3 into the retard position 14 by providing an additional fluid flow from the advance chamber 8*a* to be emptied into the retard chamber 8*b* to be filled. Accordingly the second check valve 12 supports moving the rotor 3 into the advance position 15 in that an additional fluid flow is provided from the retard chamber 9*b* to be emptied into the advance chamber 9*a* to be filled.

Figure 2:
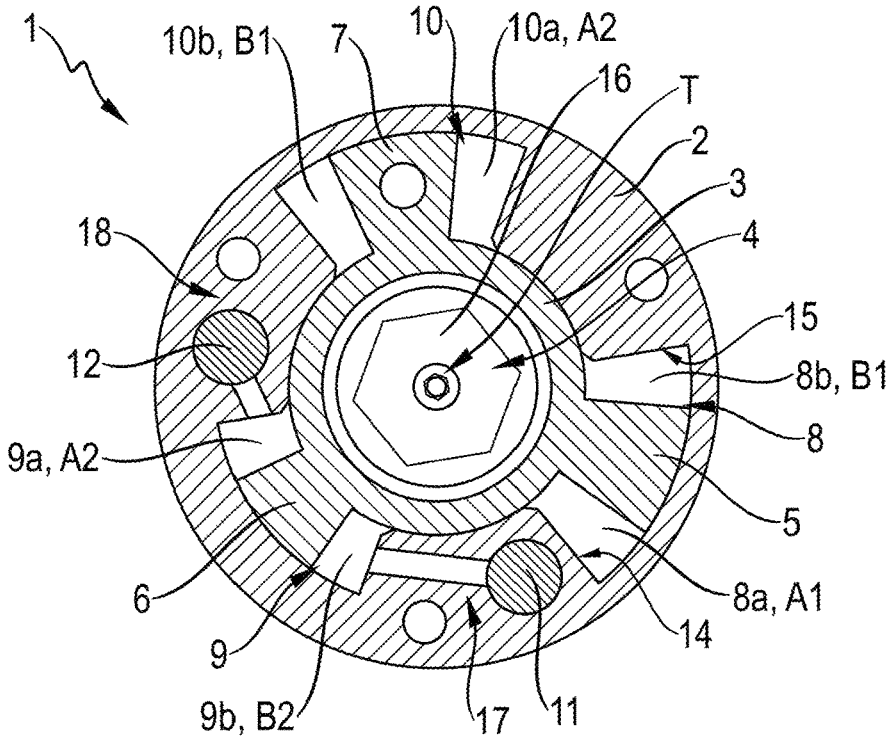
FIG. 2 illustrates a cross section of the cam phaser according to the invention in a second embodiment.

FIG. 2 illustrates the cam phaser 1 in a second embodiment and in particular only the stator 2 and the rotor 3 in a cross sectional view. A valve head 16 and a tank connection T of the control valve 4 are shown in an outside view. As illustrated in FIG. 1 the cam phaser 1 includes the operating chambers 8*a*, 8*b*, 9*a*, 9*b*, 10*a*, 10*b* that are formed by the vanes 5, 6, 7 and the vane cells 8, 9, 10, wherein the operating chambers are connected with the operating connections of the operating connection variants A1, A2, B1, B2. However, the check valves 11, 12 are arranged in the stator 2 in this second embodiment. In particular the first check valve 11 is arranged in a first stator portion 17 between the first advance chamber 8*a* and the second retard chamber 9*b* and the second check valve 12 is arranged in a second stator portion 18 between the second advance chamber 9*a* and the third retard chamber 10*b*.

Like in the first embodiment moving the rotor 3 into the retard position 14 is supported by the first check valve 11 and moving the rotor into the advance position 15 is supported by the second check valve 12. The retard position 14 and the advance position 15 are designated in FIG. 2 with reference to the first vane cell 8. This support of the movement of the rotor 3 is performed herein by other operating chambers, namely the recited operating chambers 8*a*, 8*b*, 9*a*, 9*b*, 10*a*, 10*b*.

Thus, the first check valve 11 supports moving the rotor 3 into the retard position 14 in that the additional fluid flow is now provided from the advance chamber 8*a* that is to be emptied into the retard chamber 9*b* that is to be filled. The second check valve 12 supports moving the rotor 3 into the advance position 15 in that the additional fluid flow is now provided from the retard chamber 10*b* to be emptied into the advance chamber 9*a* to be filled.

Another difference of the second embodiment over the embodiment of FIG. 1 is that the vanes 5, 6, 7 and the vane cells 8, 9, 10 have diameters that differ from each other. In particular the second vane 6 and the second vane cell 9 has a smaller diameter than the other vanes 5, 7 and the vane cells 8, 10. Consequently the operating chambers 9*a*, 9*b* are smaller than the other operating chambers 8*a*, 8*b*, 10*a*, 10*b*. A different pressure force requirement when moving the rotor 3 into the retard position 14 and the advance position 15 is thus balanced or compensated.

FIG. 3*a* illustrates the control valve 4 of FIG. 1 in a first longitudinal sectional view. The control valve 4 includes a housing 19 which envelopes a piston channel 20. The housing 19 additionally includes a total of six operating connections 21*a*, 22*a*, 23*a*, 21*b*, 22*b*, 23*b* and the tank connection T that are all connected with the piston channel 20. Fluid can drain through the tank connection T and run through at least one of the operating connections 21*a*, 22*a*, 23*a*, 21*b*, 22*b*, 23*b* into the piston channel 20. The operating connections 21*a*, 22*a*, 23*a*, 21*b*, 22*b*, 23*b* are three advance connections 21*a*, 22*a*, 23*a* and three retard connections 21*b*, 22*b*, 23*b* which are connected with the corresponding advance chambers 8*a*, 9*a*, 10*a* and the retard chambers 8*b*, 9*b*, 10*b* illustrated in FIGS. 1 and 2.

In particular the first advance connection 21*a* is connected with the first advance chamber 8*a* and the first retard connection 21*b* is connected with the first retard chamber 8*b*. Accordingly the second advance connection 22*a* is connected with the second advance chamber 9*a* and the second retard connection 22*b* is connected with the second retard chamber 9*b*. Furthermore the third advance connection 22*a* is connected with the third advance chamber 10*a* and the third retard connection 23*b* is connected with the third retard chamber 10*b*.

As recited supra the operating connections 21*a*, 22*a*, 23*a*, 21*b*, 22*b*, 23*b* are grouped in the operating connection variants A1, A2, B1, B2. The subsequent table shows the grouping

| Operating connection variant | A1 | A2 | B1 | B2 |
|---|---|---|---|---|
| Operating connection | 21a | 22a, 23a | 21b, 23b | 22b |

Furthermore the piston channel 20 includes an axially movable hollow piston 24 in a first embodiment which envelopes an inflow portion 25. This inflow portion 25 is connected with a pressure medium connection at an end of the hollow piston 24 that is oriented away from the tank connection T.

Furthermore the inflow portion 25 is connected with a portion 27 of the piston channel 20 through plural inflow openings 26. This portion 27 is separable from a remainder of the piston channel 20 by an outer structure of the hollow piston 24. Displacing the hollow piston 24 facilitates positioning the portion 27 so that a connection is established to one or plural operating connections selected from the operating connections 21*a*, 22*a*, 23*a*, 21*b*, 22*b*, 23*b* to which fluid can be supplied through the pressure medium connection P. The remaining operating connections, 21*a*, 22*a*, 23*a*, 21*b*, 22*b*, 23*b* are then connected with the remainder of the piston channel 20 so that a draining of the fluid towards the tank connection T is facilitated.

Depending on a position of the hollow piston 24 this direct access to the tank connection T through the piston channel 21 can be blocked e.g. by the outer structure of the hollow piston 24 recited supra. In this at least one tank drain channel 29 is configured in a housing wall 28 of the housing 19 wherein the tank drain channel 29 is connected with the tank connection T and runs in parallel to the piston channel 20. Thus, the fluid can be run in an opposite direction to the tank connection T out of the piston channel 20 and then through the tank drain channel 29 to the tank connection T.

According to the invention the hollow piston 24 is movable into at least a first switching position 30 and second switching position 31 wherein FIG. 3*a* illustrates the hollow piston 24 in the second switching position 31. In the illustrated embodiments the advance connections 22*a* and 23*a* are connected with the pressure medium connection P in the second switching position 31 and the advance connection 21*a* and all retard connections 21*b*, 22*b*, 23*b* are connected with the tank connection T. This means that the rotor 3 in FIG. 1 is moved into the advance position 15.

FIG. 3*b* illustrates the control valve 4 of FIG. 1 in a second longitudinal sectional view that shows the tank drain channel 29. Besides the hollow piston 24 being provided in a second embodiment the control valve 4 in FIG. 3*b* corresponds the control valve in FIG. 3*a*

The hollow piston 24 in FIG. 3*b* differs from the hollow piston 24 in FIG. 3*a* in two respects.

First of all the hollow piston 24 in FIG. 3*b* is illustrated in the first switching position 30. In the illustrated embodiments the two retard connections 21*b* and 23*b* are connected in the first switching position 30 with pressure medium connection P and the retard connection 22*b* and all advance connections 21*a*, 22*a*, 23*a* are connected with the tank connection T. This means that the rotor 3 in FIG. 1 is moved into the retard position 14.

Secondly a third check valve 32 is arranged in the hollow piston 24 wherein the third check valve separates a back flow portion 33 from the inflow portion 25. Thus, the third check valve 32 is configured permeable in a direction towards the inflow portion 25. Plural back flow openings 34 facilitate that a portion of the fluid that flows through the piston channel to the tank drain T can flow into the back flow portion 33 and through the third check valve 32 into the inflow portion 25. Thus, a recirculation occurs so that less fresh fluid has to be fed through the pressure medium connection P which facilitates a higher adjustment speed of the cam phaser 1 as recited supra.

What is claimed is:

1. A cam phaser for an internal combustion engine, the cam phaser comprising:

a stator including vane cells;

a rotor configured rotatable relative to the stator and including vanes arranged in the vane cells of the stator, wherein the vanes respectively divide the vane cells into advance chambers and retard chambers;

a control valve configured to move the rotor at least between an advance position and a retard position, wherein the control valve includes a hollow piston that is axially movable within a piston channel, a pressure medium connection, a tank connection and at least four operating connections including at least one advance connection and at least one retard connection, wherein each of the vane cells includes an advance chamber that is connected to the control valve through the at least one advance connection and a retard chamber that is connected to the control valve through the at least one retard connection, wherein the control valve is configured so that at least one first advance connection of the at least one advance connection is connected with the pressure medium connection to move the rotor into the advance position and at least one second advance connection of the at least one advance connection and the at least one retard connection is connected with the tank connection.

2. The cam phaser according to claim 1, wherein at least one first retard connection of the at least one retard connection is connected with the pressure medium connection and at least one second retard connection of the at least one retard connection and the at least one advance connection are connected with the tank connection to move the rotor into the retard position.

3. The cam phaser according to claim 1, wherein the hollow piston is movable into at least a first switching position and a second switching position, wherein the at least one first retard connection is connected with the pressure medium connection and the at least one second retard connection and the at least one advance connection are connected with the tank connection when the hollow piston is in the first switching position, wherein the at least one first advance connection is connected with the pressure medium connection and the at least one second advance connection and the at least one retard connection are connected with the tank connection when the hollow piston is in the second switching position.

4. The cam phaser according to claim 1, wherein the control valve includes a housing wall including a tank drain channel that runs parallel to the piston channel and that is connected at least with the tank connection.

5. The cam phaser according to claim 1, wherein a first advance chamber of the advance chambers is connected with a first retard chamber or a second retard chamber of the retard chambers through a first check valve that is permeable at least in a direction towards the first retard chamber or the second retard chamber.

6. The cam phaser according to claim 1, wherein a second advance chamber of the advance of the advance chambers is connected with a second retard chamber or a third retard chamber of the retard chambers through at least one second check valve that is permeable in a direction towards the second advance chamber.

7. The cam phaser according to claim 5, wherein at least one of the first check valve and a second check valve is arranged in at least one of the vanes of the rotor.

8. The cam phaser according to claim 5, wherein at least one of the first check valve and a second check valve is arranged in the stator.

9. The cam phaser according to claim 1, wherein the hollow piston includes an inflow portion that is connected with the pressure medium connection and a back flow portion that is connected with the tank connection, and wherein the inflow portion and the backflow portion are separated from each other by a third check valve that is permeable in a direction towards the inflow portion.

10. The cam phaser according to claim 1, wherein at least one of the vanes and an associated vane cell has a smaller diameter than at least one other vane and an associated vane cell.

11. The cam phaser according to claim 1, wherein at least one of the vanes includes a recess and is arrestable at the stator by a safety pin that engages the recess.

12. A method for operating a cam phaser including a stator and a rotor that form plural advance chambers and plural retard chambers and a control valve with a hollow piston that is axially movable in a piston channel between at least two switching positions, the method including:

moving the hollow piston within the piston channel into a first switching position or a second switching position;

flowing fluid from a pressure medium connection into the hollow piston (24); and introducing the fluid into at least one of the plural advance chambers and draining the fluid at least from one other advance chamber of the plural advance chambers and from the plural retard chambers, or introducing the fluid into at least one retard chamber of the plural retard chambers and draining the fluid from at least one additional retard chamber of the plural retard chambers and from the plural advance chambers.

13. The method according to claim 12, wherein the draining includes introducing at least a portion of the fluid through at least one first check valve arranged in the rotor or in the stator from at least one of the advance chambers into at least one of the retard chambers when fluid directly flowing from the pressure medium connection is introduced into the at least one retard chamber.

14. The method according to claim 12, wherein the draining includes introducing at least a portion of the fluid through at least one second check valve arranged in the rotor or in the stator from at least one of the retard chambers into at least one of the advance chambers when the fluid flowing in directly from the pressure medium connection is introduced into the at least one advance chamber.

15. The method according to claim 12, wherein the draining includes returning a portion of the fluid through a third check valve arranged in the hollow piston and adding the portion of the fluid to fluid directly flowing from the pressure medium connection.

* * * * *